US005398818A

United States Patent [19]

McGarvey

[11] Patent Number: 5,398,818

[45] Date of Patent: Mar. 21, 1995

[54] CENTER SHOT SORTING SYSTEM AND METHOD

[75] Inventor: Kenneth J. McGarvey, Central Point, Oreg.

[73] Assignee: Simco/Ramic Corporation, Medford, Oreg.

[21] Appl. No.: 194,090

[22] Filed: Feb. 9, 1994

Related U.S. Application Data

[62] Division of Ser. No. 890,966, May 29, 1992, Pat. No. 5,305,894.

[51] Int. Cl.[6] ..... B07C 5/342; B07C 5/00

[52] U.S. Cl. ..... 209/580; 209/587; 209/639; 209/939; 382/8; 382/28; 348/89; 348/91

[58] Field of Search ..... 209/576, 577, 580, 581, 209/582, 587, 639, 939; 382/8, 18, 23, 28, 54; 348/89, 91

[56] References Cited

U.S. PATENT DOCUMENTS

| | | | |
|---|---|---|---|
| 4,344,539 | 8/1982 | Lockett | 209/587 X |
| 4,759,074 | 7/1988 | Iadipaolo et al. | 382/23 |
| 5,058,174 | 10/1991 | Carroll | 382/8 X |
| 5,085,325 | 2/1992 | Jones et al. | 209/939 X |
| 5,148,923 | 9/1992 | Fraenkel et al. | 209/639 X |
| 5,305,894 | 4/1994 | McGarvey | 209/580 |

*Primary Examiner*—Cheryl L. Gastineau

*Assistant Examiner*—Tuan N. Nguyen

*Attorney, Agent, or Firm*—Stoel Rives Boley Jones & Grey

[57] ABSTRACT

A system and method for sorting items (16) computes the geometric center ("centroid") (156) of any item containing a defect (26) or multiple defects, and directs an ejection air blast at the centroid of the defective item rather than at the location of the defect. Video data from a scanning camera (24) are transmitted to an "item processor" (32A') and a "defect processor" (32). The item processor builds in memory (108) an image of every acceptable or defective item while the defect processor builds a "defect list" (170) of defect coordinate locations detected only on defective items. The defect processor transmits the defect list to the item processor where the defect list is compared with the stored image of the item. For each item containing at least one defect, the item processor computes a defective item centroid that is added to a defective items list (174) for use by a defect removal process that actuates air blasts directed toward the centers of defective items. Air blasts directed toward the centroids of defective items maximize their deflection and minimize item spinning and thereby improve item rejection efficiency and reduce the inadvertent bumping of adjacent acceptable items toward the rejection conveyor. If multiple defects are detected on a single item, a single air blast is directed at the centroid of the defective item.

21 Claims, 3 Drawing Sheets

32D
118
SYSTEM BUS
32C
32B
32A,32A'
FFE BUS
12
LIGHT PEN
OUT
DEF.
INTR.
DIGITAL VIDEO BUS
FFE BOARDS
114
CONTROL COMPUTER
VGA DISPLAY
48
44
46
NEW LINE INTR.
DUAL PORT INTERFACE
56
DUAL PORT INTERFACE
50
18
CONT. INTR.
30
FRAME GRABBER
52
BUS MASTER COMPUTER
14
RGB DISPLAY
54
DEFECT REMOVAL DRIVER
34
ADC AND CAMERA CONTROL
RGB VIDEO
24
CAMERA
SCAN CLOCK
ROTO PULSE
INTR.
10
28
22
26
40
38
42
16
18
ACCEPTABLE ITEMS
16
20
36
40
40
40
DRIVE MOTOR

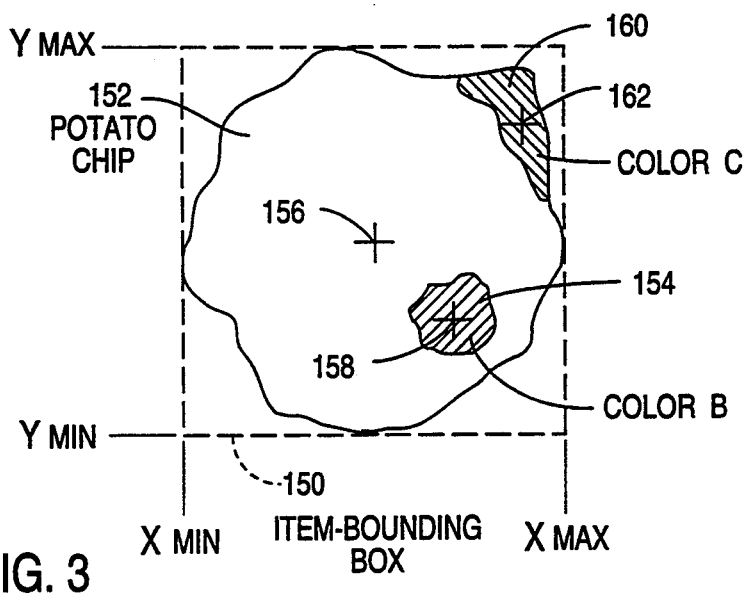
FIG. 3
FIG. 4
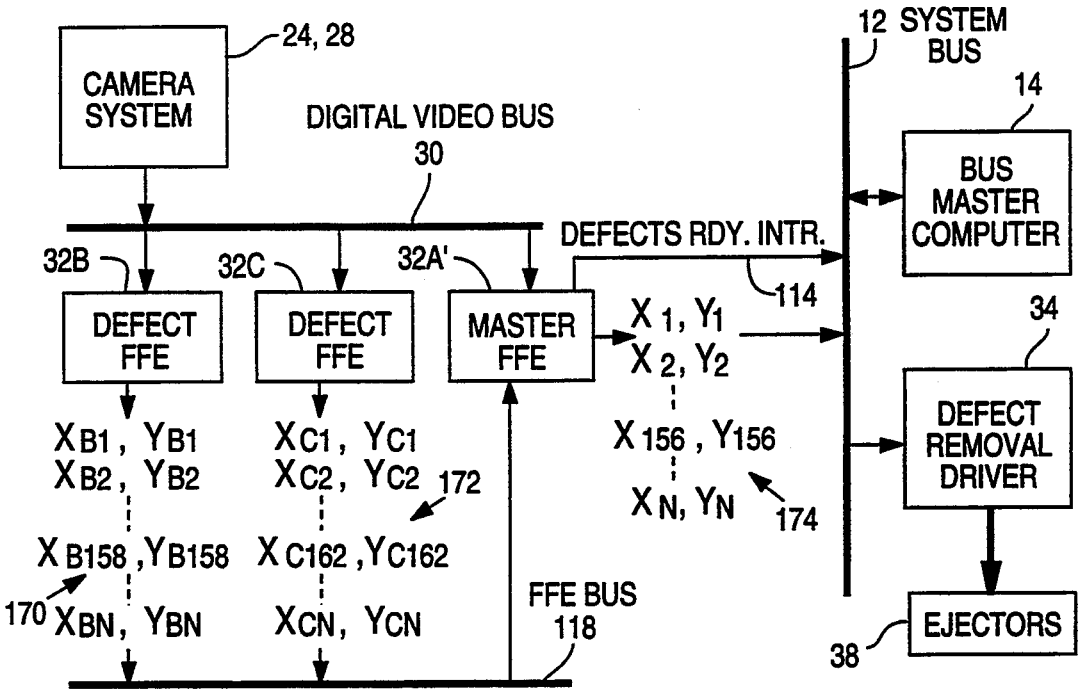

CENTER SHOT SORTING SYSTEM AND METHOD

This is a division of application Ser. No. 07/890,966, filed May 29, 1992, now U.S. Pat. No. 5,305,894.

TECHNICAL FIELD

This invention relates to agricultural product inspection and sorting systems and more particularly to photo-optical apparatus and methods for improved sorting of defective products from acceptable products previously inspected in an optical inspection zone.

BACKGROUND OF THE INVENTION

There have been known apparatus and methods for sorting defective items from acceptable items by using machine vision techniques. Defect sorting systems based on such techniques have been commonly applied in the food product industry for the removal of fruits or vegetables containing defects. U.S. Pat. No. 5,085,325 of Jones et al. for COLOR SORTING SYSTEM AND METHOD, assigned to the assignee of the present invention, describes one such sorting system having a color camera for inspecting items as they are moved or propelled through an inspection zone by a conveyor belt. Color video data from the camera are digitized and used to address a lookup table containing criteria representing acceptable and rejectable colors. When the camera detects an item having a defect color, the defect location is stored in a memory for subsequent rejection of the item downstream of the camera. Conveyor belts typically move with sufficient speed to propel items off the end of the belt where a bank of air ejectors, triggered in response to stored defect data, are positioned to deflect defective items toward a rejection conveyor, while allowing acceptable items to fly undeflected toward an acceptance conveyor.

Such a system is quite effective at detecting the color, size, and location of defects in items. However items are often defective over only small portions of their surfaces. This creates an ejection efficiency problem for the air ejectors. Conventional defect sorting systems direct an air ejector blast at the detected location of a defect. For example, U.S. Pat. No. 4,276,983 of Witmer for SORTING APPARATUS describes a potato sorting system that includes a compressed air jet for deflecting defective potatoes into a reject bin. In such a system, when the air blast is directed toward a defect located at the edge of the potato slice, its trajectory may be insufficiently altered to deflect it toward the rejection conveyor. In some instances the air blast will cause the defective potato slice to spin toward the acceptance conveyor, often "bumping" acceptable items toward the rejection conveyor.

An item may also contain multiple defects. Conventional sorting systems direct an air blast at each defect location causing redundant operation of the air ejectors that leads to excessive wear and reliability problems. Moreover, the resulting excessive air blast can itself be deflected by the defective item toward an adjacent acceptable item causing its inadvertent rejection.

What is needed, therefore, is an apparatus and a method for improving the ejection efficiency of items containing non-centered or multiple defects.

SUMMARY OF THE INVENTION

An object of this invention is, therefore, to improve the ejection efficiency of an inspection and sorting system when items containing non-centered or multiple defects are detected.

Another object is to render this invention retrofittable to existing inspection and sorting systems.

This invention provides an improved system and method for sorting items by computing the geometric center ("centroid") of any item containing a defect or multiple defects, and directing an ejecting air blast at the centroid of the defective rather than at the location of the defect.

Video data from a scanning camera are transmitted to an "item processor" and a "defect processor." The item processor builds in memory an image of every acceptable or defective item while the defect processor builds a "defect list" of defect coordinate locations detected only on defective items. The defect processor transmits the defect list to the item processor where the defect list is compared with the stored image of the item. For each item containing at least one defect, the item processor computes a defective item centroid that is added to a defective item list for use by a defect removal process that actuates air blasts directed toward the centers of defective items.

Air blasts directed toward the centroids of defective items maximize their deflection and minimize item spinning item and thereby improve item rejection efficiency and reduce the inadvertent bumping of adjacent acceptable items toward the rejection conveyor.

If multiple defects are detected on a single item, a single air blast is directed at the centroid of the defective item. Fewer acceptable items are inadvertently rejected because a single air blast centered on an item with multiple defects is less likely to inadvertently deflect an adjacent acceptable item.

Additional objects and advantages of this invention will be apparent from the following detailed description of a preferred embodiment thereof which proceeds with reference to the accompanying drawings.

BRIEF DESCRIPTION OF THE DRAWINGS

FIG. 3 is a plan view of a defective potato chip enclosed by a bounding box.

FIG. 4 is a simplified functional block diagram of the overall center shot sorting system showing the separate data flow paths for defect centroids and defective item centroids.

DETAILED DESCRIPTION OF PREFERRED EMBODIMENT

Figure 1:
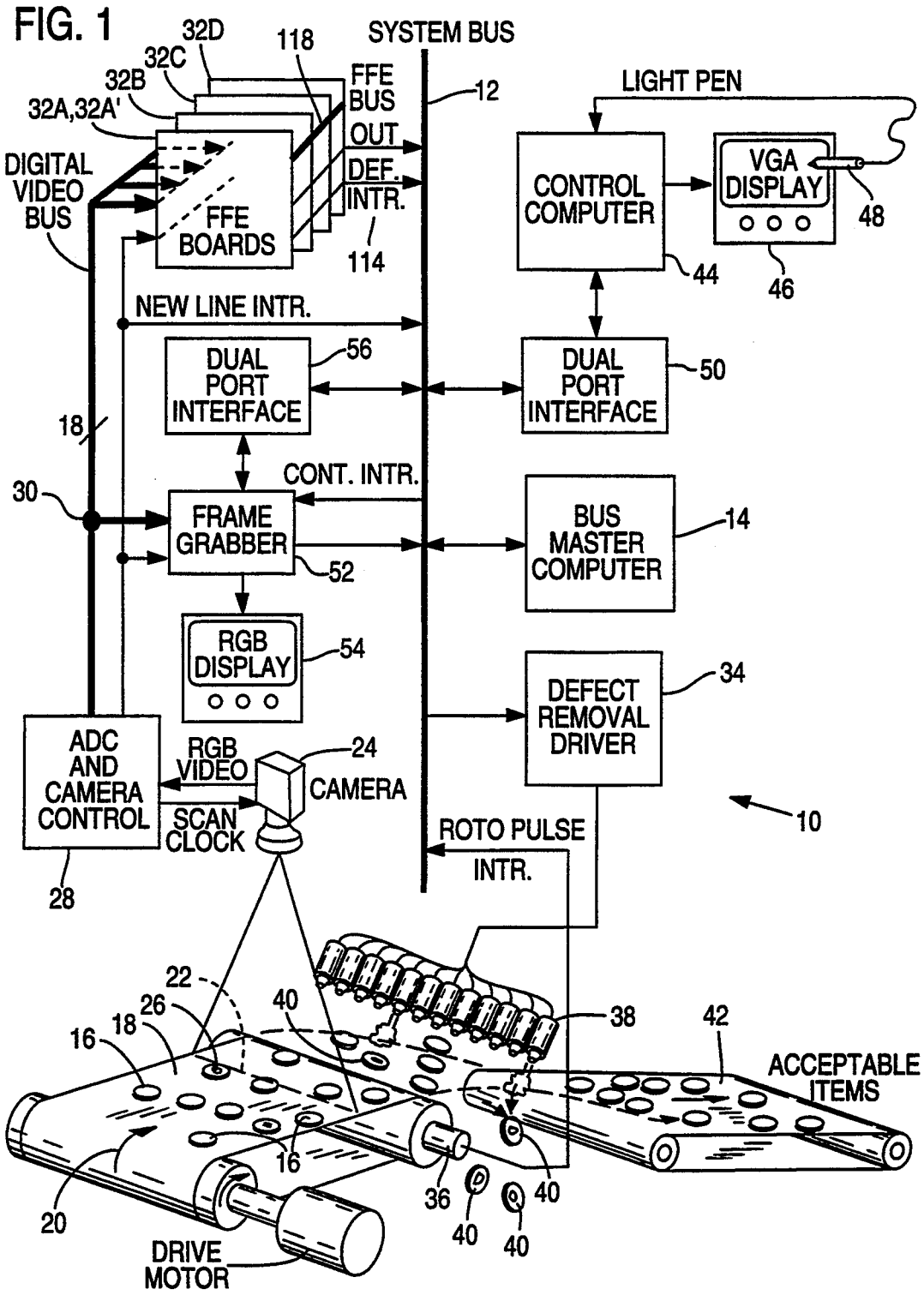
FIG. 1 is an overall system-level block diagram of a sorting system according to this invention, including a pictorial diagram of items being conveyed, inspected, and sorted.

Referring to FIG. 1, an inspection and sorting system 10 includes electronic analysis and control boards embedded on a system bus 12, which is preferably an industry standard VME bus. A bus master computer 14 based on an Intel® 386 microprocessor serves as controller of the boards embedded on system bus 12.

In operation, items 16 are randomly scattered on a conveyor belt 18 and moved in the direction of arrow 20 through an inspection zone 22 positioned transversely across conveyor belt 18. Inspection zone 22 is defined by the field of view of a line scanning CCD array camera 24 that is shown scanning items 16 one of which includes a defect 26. Camera 24 generates red, green, and blue analog pixel signals which are sent to an analog-to-digital converter and camera control ("ADC") board 28. The analog pixel signals each have amplitudes that are proportional to the amount of radiation received by three arrays of CCD transducers sensitive to predetermined bandwidths of radiation, preferably centered on frequencies of red, green, and blue light. Camera 24 generates analog pixel signals in response to radiation spanning the entire visible spectrum of light but is not limited to the visible spectrum. Each color analog pixel signal is digitized to 8-bits and normalized via conventional gain-RAM and digital multiplier techniques. The two least-significant bits of each digitized pixel signal are discarded, and the resulting three 6-bit digital pixel data signals are concatenated to form an 18-bit wide stream of digital video words, one word corresponding to each pixel position of each scan of line scanning CCD array camera 24. The 18-bit digital video words are placed on a digital video bus 30 for analysis and processing to be described later.

During inspection of items 16 by camera 24, the video data containing defect 26 are placed on digital video bus 30 by ADC board 28. A set of find, filter, and eject ("FFE") boards 32A, 32B, 32C, and 32D (collectively, "FFEs 32") processes the digital video and generates defect lists that are mapped by master computer 14 into ejector patterns. Bus master computer 14 places the ejector patterns in a memory queue, and in response to roto-pulses from an incremental shaft encoder 36 coupled to conveyor belt 20, the queue is advanced. By the time an item 16 having a defect 26 has traveled from inspection zone 22 into the path of at least one of multiple ejector modules 38, the matching ejection pattern has been advanced to the end of the queue and sent to a defect removal driver board 34. A defective item 40 is subsequently deflected by a blast of air from the appropriate ejector module or modules 38. Acceptable items 16 pass undeflected through the region of ejector modules 38 and land on an acceptance conveyor belt 42 or some other collecting means.

In an alternate embodiment of this invention, inspection zone 22 of camera 24 is displaced downstream from conveyor belt 18 but ahead of ejector modules 38. This embodiment, referred to as "off-belt inspection" allows camera 24 to scan items 16 as they are propelled in the air from the end of conveyor belt 18 toward ejector modules 38. Off-belt inspection allows mounting camera 24 below items 16; such camera positioning is beneficial for inspection of certain kinds of items. Off-belt inspection provides a predictable background color for inspection that prevents dirt and contaminants on conveyor belt 18 from causing anomalous video signals that could lead to sorting errors.

Operator interface to inspection and sorting system 10 is accomplished by means of a control computer 44 including a VGA display 46 and a light-pen 48. Control computer 44 is preferably a PC-AT in which light-pen 48 provides a graphical operator interface for system setup, commands, and parameter adjustments. Control computer 44 communicates with bus master computer 14 over system bus 12 via a 32-kilobyte dual-port interface memory 50. Bus master computer 14 either executes various light-pen selected commands or relays these commands to other devices on system bus 12. Control computer 44 includes a hard disk for storing operator selected setup parameters, product defect histograms, and other initialization data.

A frame grabber board 52 captures sequential words of digital video data from digital video bus 30 and builds up full-color images of items 16 on belt. 18 that are displayed on an RGB monitor 54. The operator uses light-pen 48 to select colors displayed on RGB display 54 that represent acceptable items 16, defects 26, and conveyor belt 18. The selected colors are transferred from frame grabber 52 through a dual-port interface 56 to FFEs 32 by bus master computer 14. The selected colors are used to load color lookup tables on FFEs 32 with data for determining whether items 16 are acceptable or rejectable. The above-mentioned U.S. Pat. No. 5,085,325 of Jones et al. describes various methods of loading color lookup tables with accept/reject and other data.

Figure 2:
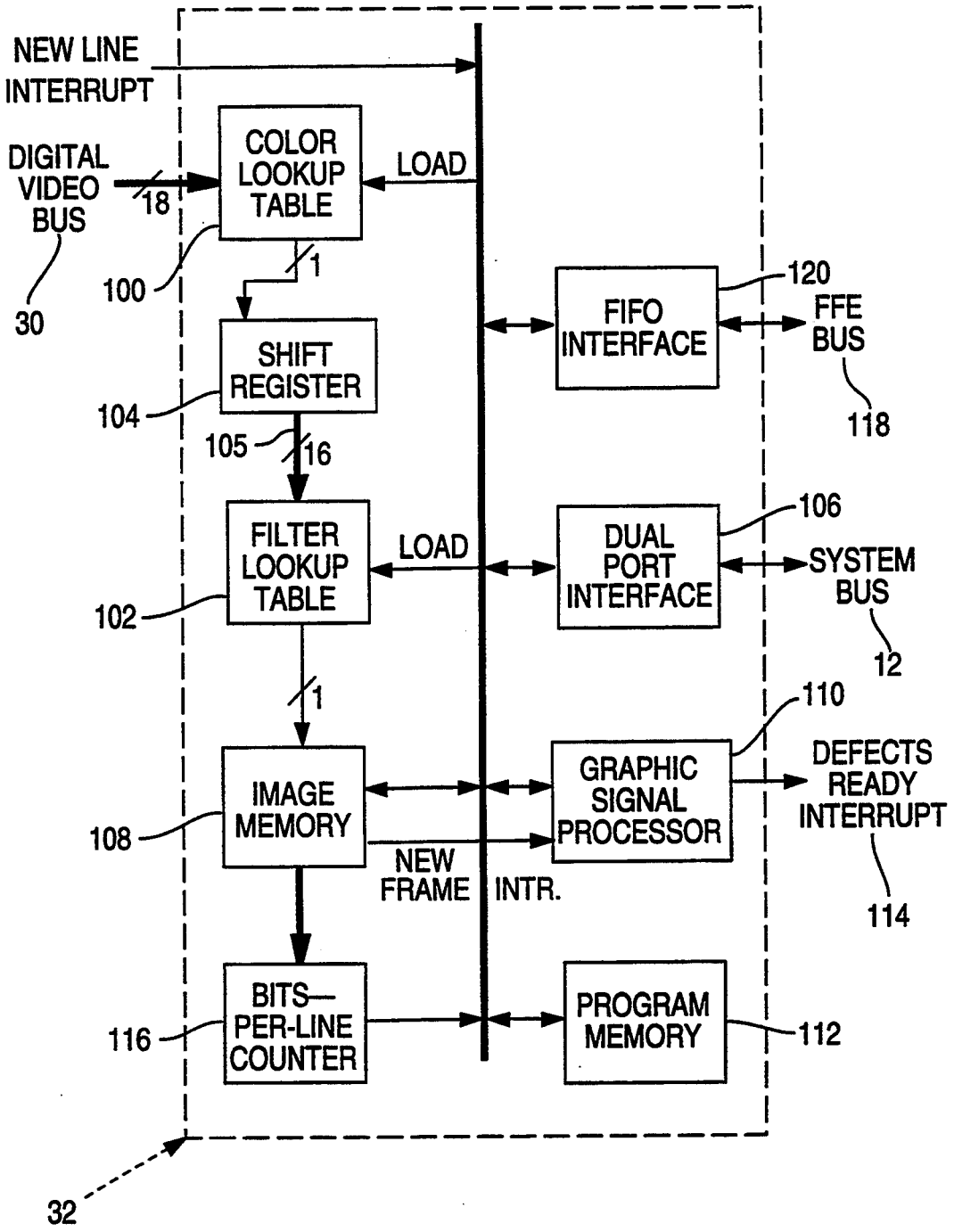
FIG. 2 is a functional block diagram of a find, filter, and eject ("FFE") circuit board according to this invention.

Digital video data are transferred from ADC board 28 to FFEs 32 on digital video bus 30. Referring to FIG. 2, FFEs 32 are multi-purpose image analysis boards, each including a color lookup table ("CLUT") 100 containing accept/reject data loaded according to the above description. The 18-bit words on digital video bus 30 act to address CLUT 100, which has an address space of 262,144 locations to accommodate all possible combinations of color addresses.

The output from CLUT 100 is a serial binary data stream of logic 1's and 0's at the 18-bit word rate on digital video bus 30. The one bit per eighteen word rate represents an 18:1 data compression ratio, thereby facilitating subsequent computations.

The serial binary data stream from CLUT 100 is fed into a filter lookup table ("FLUT") 102. FLUT 102 has a 16-bit address space and contains 65,536 addressable memory locations. The address for FLUT 102 is formed by shifting the serial binary data stream from CLUT 100 into a 16-bit shift register 104. A 16-bit output bus 105 from shift register 104 forms the address for FLUT 102 and consists, at any given time, of the 16 previous data states shifted into 16-bit shift register 104 from CLUT 100. Each bit received from CLUT 100 corresponds to a sequential 18-bit word on digital video bus 30, and each sequential 18-bit word corresponds to an incremental (pixel sized) location along inspection zone 22 on conveyor belt 18 (FIG. 1). The number of sequential 18-bit words generated as a result of each scan of inspection zone 22 by camera 24 depends on the number of transducers in each CCD array of camera 24.

FLUT 102 performs a digital filtering operation on the binary data stream. The filter function to be performed is selectable by the operator via light-pen 48 from VGA display 46. Control computer 44 loads FFE 32 with the selected filter data via dual port interface 50, system bus 12, and a dual port interface 106 in FFE 32. Preferably there are seven filter selections including a first selection that does nothing to the binary data stream, a second selection that removes all single 1's and trailing 1's in a group of 1's, and a third selection that removes all single 1's and all grouped pairs of 1's.

To filter the sequential binary data stream at the output of CLUT 100 in the manner described above, the filtering operation for any given address of FLUT 102 has to be based on data states preceding and subsequent to the data bit being examined. This causes delay in the filtering process because bits must be shifted into the address of FLUT 102 before a properly filtered output can be generated. This delay is inherent in the manner in which FLUT 102 is addressed and programmed.

By convention, the most recent data bit is designated the most significant bit (MSB) of the FLUT 102 address, the 16th prior bit is designated the least significant bit (LSB), and the 8th bit in the sequence is designated the bit being "filtered." In this manner FLUT 102 addresses filter data with "knowledge" of 8 prior bits and the 7 subsequent bits. If the operator selects a filter that removes a single leading "1" and a single trailing "1" from a group of three 1's, the address will have a 1 stored at that memory location, as shown below.

FLUT Address: 0000001110000000
MSB 8 LSB

The output of FLUT 102 is also a sequential binary data stream with a delay of 8 bits with respect to the binary data stream from CLUT 100. This delayed, filtered binary data stream is written into an image memory 108 on FFE 32. FFE 32 also includes a graphic signal processor ("GSP") 110 such as type 34010 available from Texas, Instruments, Inc., Dallas, Tex. Image memory 108 is within the address space of GSP 110, which forms the "image" of the filtered serial data by storing the data as a raster of line scans. GSP 110 then inspects image memory 108 for horizontal and vertical groupings of 1's that delineate defects 26 in items 16 being scanned by camera 24.

In particular, each line of data in image memory 108 is traversed by GSP 110 under control of a program stored in a program memory 112. The program causes GSP 110 to search image memory 108 for contiguous horizontal groupings of 1's. When such a grouping is found, the minimum and maximum X-coordinate values of the leading and trailing edge of the grouping are stored in a defect list in dual port interface 106 and are assigned a defect number. The area (number of 1's) for that defect is recorded by storing the number of contiguous 1's in the grouping. Subsequent groups of 1's on the same line are treated alike and assigned the next sequential defect number in the defect list.

The searching process is repeated for subsequent horizontal lines in image memory 108. The $X_{MIN}$ and $X_{MAX}$ values of the subsequent line are compared to those in the defect list and where an overlap occurs, the grouping in the subsequent line is assigned the same defect number. Where overlap occurs and the grouping in the subsequent line has a larger $X_{MAX}$ or a smaller $X_{MIN}$, the defect list values for $X_{MIN}$, $X_{MAX}$, $Y_{MIN}$, and $Y_{MAX}$ are updated. The corresponding defect area is also incremented by adding the number of 1's in the grouping of the subsequent line to the area number for the previous line. When the process is completed, the defect list contains the minimum and maximum X- and Y-coordinate values inside of which lie the defects and the areas of the defects. The minimum and maximum X- and Y-coordinate values also form a "defect-bounding box" that surrounds each defect. The geometric centers ("centroids") of the defect-bounding boxes are computed as $(X_{MIN}+X_{MAX})/2$ and $(Y_{MIN}+Y_{MAX})/2$. A preferred format for the defect list is:

| DEFECT | $X_{MIN}$ | $X_{MAX}$ | $Y_{MIN}$ | $Y_{MAX}$ | AREA (defect) |
|---|---|---|---|---|---|
| 1 | | | | | |
| 2 | | | | | |
| . | | | | | |
| . | | | | | |

-continued

| |
|---|
| . |
| n |

When the defect list is completed, GSP 110 computes a defect centroid for each item in the defect list and builds a defect centroid list. A defects ready interrupt signal 114 is generated by GSP 110 to alert bus master computer 14 that the defect centroid list is ready. (Optionally, the defect list can be sent to a first-in-first-out ("FIFO") memory for transmission to another FFE board in a manner to be described later.) Bus master computer 14 then reads the defect centroid list from program memory 112 via dual port interface 106 and maps the defect centroid X- and y-coordinate values into ejector patterns for subsequent transmittal to defect removal driver 34. Defect size (area) limits are selected by the operator via light-pen 48. Selected sizes are compared by GSP 110 with the defect areas listed in the defect list to determine which defects are sufficient large to warrant computing and listing defect centroids for sending to bus master computer 14 and mapping into ejector patterns.

If defects meeting multiple color and size criteria are to be removed, a separate FFE 32 is used for each combination of defect color and size. For example, FFE 32A detects small black defects, FFE 32B detects larger brown defects, FFE 32C detects green stem-sized defects, and FFE 32D detects yellow soft-center sized defects.

Each FFE board 32 locates, lists, and reports the centroids of defects scanned into its own image memory 108. Each image memory 108 contains 128 scan lines of memory with 1024 bits per line. Defective colors in image memory 108 are preferably represented by a logic "1" bit and acceptable colors are represented by a logic "0" bit. Alternately, the opposite logical sense could be used.

Contention exists between the FFE hardware and FFE program because FLUT 102 writes new scan line data to image memory 108 while the GSP 110 program is processing old scan line data. To avoid the contention, image memory 108 is divided into frames. GSP 110 is programmed so that FLUT 102 and GSP 110 are never accessing scan lines in the same frame at the same time. Furthermore, FLUT 102 is designed to send a "new-frame" interrupt signal to GSP 110. Using this interrupt signal, the GSP program knows when to access the next frame of data. GSP 110 also notifies the program when it must abandon a previous frame of data. The number of lines in a frame is programmable.

Alternatively, the defect finding program can process data in image memory 108 on a line-by-line basis because only two scan lines are needed in image memory at any one time. While GSP 110 is processing one scan line, FLUT 102 is writing to the other. In this case, GSP 110 is programmed to generate a "new-frame" interrupt signal on every scan line and the frame size is set to "one." For any scan line, when a defect has been located, the defect X-, Y-coordinate location is written to dual port memory 106. For every 64th scan line, the GSP 110 is programmed to generate defects ready interrupt signal 114.

Another contention exists between bus master computer 14 and FFE 32 at dual port interface 106. In particular, bus master computer 14 cannot receive a defect centroid list from dual port interface 106 while GSP 110 is adding new defects to the same list. To prevent this contention, dual port interface 106 is divided into two halves. Defects ready interrupt signal 114 also informs master computer 14 which half of dual port interface 106 to access. GSP 110 then uses the other half to write the next defect centroid list. In operation, GSP 110 "ping-pongs" between the two halves of dual port interface 106. FFEs 32 also contain a set of bits-per-line counters 116 (one for each scan line) for counting the number of defect bits in each scan line of image memory 108. Before GSP 110 processes bits in any scan line, the program reads the bits-per-line counter 116 for the particular scan line and ignores the scan line if the number of defect bits does not exceed a predetermined number.

One particular embodiment of this invention is directed toward center shot sorting of items 16 such as flat items (e.g., potato chips) or non-flat items (e.g., whole strawberries and radishes with stems). A "master-FFE" 32A', having the same hardware as FFEs 32, is programmed to detect entire items by detecting everything that is not substantially belt-colored (i.e., detecting the entire item as though it were a defect). FFEs 32 are programmed to detect defects in the items as described above and to communicate the defect locations over an FFE bus 118 that is connected to a FIFO interface 120 on FFEs 32 and master-FFE 32A'. In the center shot sorting application, dual port interfaces 106 of FFEs 32 are not used.

Master-FFE 32A' builds a stored representation of the image of each item by storing in image memory 108 a logic 1 at each X- and Y-coordinate location that corresponds to an actual location on each item. As a convention, the X-coordinate corresponds to the scanning direction for line scan camera 24, and the Y-coordinate represents the direction in which items 16 are moved past camera 24. The value of $Y_{MAX}$ is preferably not more than 64 scan lines greater than the value of $Y_{MIN}$. The number 64 is another convention, and the only limitation on $Y_{MAX}$ is that it represent a distance that is less than that between inspection zone 22 and ejector modules 38.

FIG. 3 shows the X- and Y-coordinates defining an item-bounding box 150 around an exemplary potato chip 152 having a defect 154 and an item centroid 156. In operation, FFE 32B detects defect 154 on potato chip 152. FFE 32B builds a defect list that includes a defect centroid 158. The X- and Y-coordinates of defect centroid 158 are sent from FFE 32B to master-FFE 32A' over FFE bus 118 and are stored in a queue (not shown) in FIFO interface 120 of master-FFE 32A'. Although master-FFE 32A' detects all potato chips on conveyor belt 18 and stores their image data in image memory 108, master-FFE 32A' computes item centroids 156 for only those potato chips having defect centroids 158 stored in FIFO interface 120. Specifically, for each defect centroid 158 coordinate pair stored in FIFO interface 120, master-FFE 32A' identifies the corresponding image coordinates for potato chip 152 stored in its image memory 108 and uses defect centroid 158 as a "trigger" to compute the $X_{max}$, $X_{min}$, $Y_{max}$, $Y_{min}$ item bounding box 150 coordinates and item centroid 156 coordinates of potato chip 152.

Item centroid 156 is computed by master-FFE 32A' as the average of the respective X- and Y-coordinate limits of item-bounding box 150:

$$X_{CENTROID}=(X_{MAX}+X_{MIN})/2$$

$$Y_{CENTROID}=(Y_{MAX}+Y_{MIN})/2.$$

Alternatively, item centroid 156 may be determined by summing the individual coordinate positions representing an item bounded by item-bounding box 150 and dividing the sum by the number of such coordinates:

$$X_{CENTROID}=\Sigma_{i=1\text{-}N}X_i/N$$

$$Y_{CENTROID}=\Sigma_{i=1\text{-}N}Y_i/N$$

Referring to FIG. 4, an item such as potato chip 152 (FIG. 3) can have multiple defects each of different colors and sizes. For example, assume for potato chip 152 that FFE 32B detects defect 154 having a color B and centroid 158 and that FFE 32C detects defect 160 having a color C and a centroid 162. FFE 32B generates a color B defect list 170 including centroid 158 coordinates $X_{B158}$, $Y_{B158}$ of defect 154 and FFE 32C generates a color C defect list 172 including centroid 162 coordinates $X_{C162}$, $Y_{C162}$ of defect 160. Defect lists 170 and 172 are sent to master-FFE 32A' over FFE bus 118 and stored in the FIFO interface queue as described above.

Potato chip 152 is represented by a group of logic 1's stored in image memory 108 of master-FFE 32A'. When master-FFE 32A' is triggered by centroid coordinates $X_{B158}$, $Y_{B158}$, bounding box 150 and centroid 156 are computed for potato chip 152, and the logic 1's representing potato chip 152 are cleared to logic 0's. The clearing operation eliminates redundant determinations of centroid 156 of potato chip 152. If subsequent defect centroid coordinates, such as $X_{C162}$, $Y_{C162}$, are otherwise capable of triggering master-FFE 32A' the absence of logic 1's at that corresponding location in image memory 108 prevents a redundant determination of centroid 156 of potato chip 152. In response to the first trigger, centroid 156 coordinates $X_{B156}$,$Y_{B156}$ of potato chip 152 are added to a defective item list 174 stored in program memory 112 (FIG. 2) of master-FFE 32A'.

An acceptable item will be detected by master-FFE 32A' but no defects associated with the acceptable item will be detected by FFEs 32. As a result, no defect centroid will have coordinates lying within the group of logic 1's that represent the acceptable item. Therefore, master-FFE 32A' will not be triggered to generate a centroid.

Referring again to FIG. 2, to avoid data contention in master-FFE 32A' its image memory 108 is divided into two 64-line frames. The master-FFE program swaps between the two frames with each new-frame interrupt. In like manner, to avoid data contention between dual port memory 106 and bus master computer 14 (FIG. 1), dual port memory 106 is divided into two halves. Defect centroids located in the first and second halves of image memory 108 are stored in the respective first and second halves of dual port interface 106.

Defective item list 174 cannot be completed until master-FFE 32A' has a complete frame of data in image memory 108. For this reason, master-FFE 32A' lags approximately one frame (64 scan lines) behind FFEs 32. FFEs 32 have their defect lists, such as 170 and 174, ready every 64th scan line. Master-FFE 32A' receives a new frame interrupt every 64 scan lines. This interrupt indicates that all defects detected by all FFEs 32 during the previous frame, are listed and ready for master-FFE 32A'. Master-FFE 32A' then reads out its FIFO interface 120, generates defective item list 174, circulates through all FFEs 32, including 32A' clearing the contents of each FIFO interface 120, and generates defects ready interrupt signal 114 to alert bus master computer 14 that defective item list 174 is ready. Bus master computer 14 then reads defective item list 174 via dual port interface 106 of master-FFE 32A' and maps the various item centroid X- and y-coordinate values of defective item list 174 into ejector patterns for transmittal to defect removal driver 34.

It will be obvious to those having skill in the art that many changes may be made to the details of the above-described embodiment of this invention without departing from the underlying principles thereof. Accordingly, it will be appreciated that this invention is applicable also to inspection and sorting applications other than those relating to food products. The scope of the present invention should, therefore, be determined only by the following claims.

I claim:

1. An apparatus for detecting an item having a defect characterized by a defect color as the item travels on or through a medium characterized by one or more background colors, comprising:

a scanning camera scanning the item and the medium to produce a defect image signal that indicates the presence of the defect color and an item image signal that indicates the absence of a background color, the absence of background color representing the presence of the item;

an image memory storing at a set of relative coordinate locations the item image signals representative of an image of the item scanned and the defect image signals representative of an image of defects on the item scanned; and a signal processor generating a defective item signal that causes a single air ejector to direct an air blast at a centroid of the item having item image signals and defect image signals that share at least one coincident coordinate location.

2. The apparatus of claim 1 further comprising a communications link sending the defective item signal to a sorting processor to sort the items.

3. The apparatus of claim 1 in which the medium comprises a conveyor belt.

4. The apparatus of claim 1 in which the medium comprises air.

5. The apparatus of claim 1 in which the coordinate locations of the item include coordinate locations of the centroid for the item, and the defective item signal includes information indicative of the centroid.

6. A method of detecting an item having a defect characterized by a defect color as the item travels on or through a medium characterized by one or more background colors, comprising the steps of:

scanning the item and the medium to produce a defect image signal that indicates the presence of the defect color and an item image signal that indicates the absence of a background color, the absence of background color representing the presence of the item;

storing in image memory locations the relative position coordinates of the item image signals representative of an image of the item scanned;

storing in image memory locations the relative position coordinates of the defect image signals representative of an image of defects on the item scanned;

generating in a sorting processor a defective item signal for each item having item signals and defect signals that share at least one coincident position coordinate; and directing a single air elector air blast at a centroid of the defective item in response to the defective item signal.

7. The method of claim 6 in which the medium comprises a conveyor belt.

8. The method of claim 6 in which the medium comprises air.

9. The method of claim 6 in which the position coordinates of the item include position coordinates of the centroid for the item, and the defective item signal includes information indicative of the centroid.

10. An apparatus for detecting an item having a defect characterized by a defect color as the item travels on or through a medium characterized by one or more background colors, comprising:

a scanning camera scanning the item and the medium to produce a defect image signal that indicates the presence of the defect color and an item image signal that indicates the absence of a background color, the absence of a background color representing the presence of the item;

an image memory storing at a set of coordinate locations the item image signals representative of an image of the item scanned and defect image signals representative of an image of defects on the item scanned;

a signal processor generating a centroid coordinate signal for the item having at least one item image signal and defect image signal that share a coincident coordinate location; and an air ejector in data communication with the signal processor directing an air blast at a centroid of the item containing the defect.

11. The apparatus of claim 10 in which the medium comprises a conveyor belt.

12. The apparatus of claim 10 in which the medium comprises air.

13. A method for detecting an item having a defect characterized by a defect color as the item travels on or through a medium characterized by one or more background colors, comprising:

scanning the item and the medium to produce a defect image signal that indicates the presence of the defect color and an item image signal that indicates the absence of a background color, the absence of a background color representing the presence of the item;

storing in an image memory at a set of coordinate locations the item image signals representative of an image of the item scanned and defect image signals representative of an image of defects on the item scanned;

generating in a signal processor a centroid coordinate signal for the item having at least one item image signal and defect image signal that share a coincident coordinate location; and directing an air blast at a centroid of the item containing the defect.

14. The method of claim 13 in which the medium comprises a conveyor belt.

15. The method of claim 13 in which the medium comprises air.

16. An apparatus for detecting an item having a defect characterized by a defect radiation amplitude as the item travels on or through a medium characterized by one or more background radiation amplitudes, comprising:

a scanning camera scanning the item and the medium to produce a defect image signal that indicates the presence of the defect radiation amplitude and a set of item image signals that indicate the absence of a background radiation amplitude, the absence of a background radiation amplitude representing the presence of the item;

an image memory storing at a set of coordinate locations the item image signals representative of an image of the item scanned and the defect image signal representative of an image of the defect on the item scanned;

a processor generating an item centroid signal if the item has at least one item image signal coordinate location that corresponds with a defect image signal coordinate location; and an air ejector in data communication with the processor directing an air blast at a centroid of the item having at least one item image signal coordinate location that corresponds with a defect image signal coordinate location.

17. The apparatus of claim 16 in which the medium comprises a conveyor belt.

18. The apparatus of claim 16 in which the medium comprises air.

19. A method for detecting an item having a defect characterized by a defect radiation amplitude as the item travels on or through a medium characterized by one or more background radiation amplitudes, comprising:

scanning the item and the medium to produce a defect image signal that indicates the presence of the defect radiation amplitude and a set of item image signals that indicate at least one of the presence of an item radiation amplitude and the absence of a background radiation amplitude;

storing in an image memory at coordinate locations the item image signals representative of an image of the item scanned and the defect image signal representative of an image of defect on the item scanned;

generating in a processor a defective item signal if the item has at least one item image signal coordinate location that corresponds with a defect image signal coordinate location; and directing an air blast at a centroid of the item having the defect.

20. The method of claim 19 in which the medium comprises a conveyor belt.

21. The method of claim 19 in which the medium comprises air.

* * * * *